US006798888B1

(12) United States Patent
Howarth et al.

(10) Patent No.: US 6,798,888 B1
(45) Date of Patent: Sep. 28, 2004

(54) MOUNT FOR UNDERWATER ACOUSTIC PROJECTOR

(75) Inventors: Thomas R. Howarth, Washington, DC (US); Walter L. Carney, Bloomfield, IN (US); James L. Merryfield, Bedford, IN (US); Patrick L. Arvin, Loogootee, IN (US); Phillip W. Meadows, Mitchell, IN (US); Scott L. Small, Newberry, IN (US); James F. Tressler, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 141 days.

(21) Appl. No.: 10/289,899

(22) Filed: Nov. 5, 2002

(51) Int. Cl.[7] ..... H04R 25/00

(52) U.S. Cl. ..... 381/162; 381/190; 381/163; 381/339; 181/149

(58) Field of Search ..... 381/152, 162, 381/163, 173, 190, 191, 339, 431; 181/161, 149; 310/324, 800

(56) References Cited

U.S. PATENT DOCUMENTS

| | | | | | |
|---|---|---|---|---|---|
| 4,845,688 | A | * | 7/1989 | Butler | 367/174 |
| 5,196,755 | A | * | 3/1993 | Shields | 310/324 |
| 6,232,702 | B1 | * | 5/2001 | Newnham et al. | 310/334 |
| 6,278,790 | B1 | * | 8/2001 | Davis et al. | 381/398 |
| 6,438,242 | B1 | * | 8/2002 | Howarth | 381/190 |
| 6,711,096 | B1 | * | 3/2004 | Benjamin | 367/162 |

* cited by examiner

*Primary Examiner*—Curtis Kuntz
*Assistant Examiner*—Brian Ensey
(74) *Attorney, Agent, or Firm*—James M. Kasischke; Michael F. Oglo; Jean-Paul A. Nasser

(57) ABSTRACT

A mount for acoustic transducers has a resilient sheet with a plurality of mounting apertures therein. Each mounting aperture has an annular groove formed about the inside surface of the sheet to accommodate one of the acoustic transducers. A pair of rigid, acoustically transparent plates are mounted on each side of the resilient sheet. Each plate has a plurality of communication apertures in it which correspond to the mounting apertures of the resilient sheet. The acoustic transducers are inserted into the mounting aperture of the resilient sheet. The acoustically transparent plates provide structural support for the mount.

14 Claims, 2 Drawing Sheets

MOUNT FOR UNDERWATER ACOUSTIC PROJECTOR

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

This invention relates to acoustic projectors for sonar use and more particularly to a mount for a plurality of acoustic projectors in an array.

(2) Description of the Prior Art

U.S. Pat. No. 6,438,242 to Howarth discloses a cymbal transducer that can be deployed in a flat panel. It is often desirable to deploy a large number of these transducers in a planar array in order to provide a thin acoustic projector having a high acoustic source level.

The cymbal transducer consists of two caps having a dome portion and an edge portion bonded to a piezoelectric disk and in electrical conduction with the disk. When an electric field is applied to the disk, it expands and contracts in its radial direction. This expansion and contraction of the disk causes the dome portion of the caps to flex up and down sending acoustic energy into the surrounding medium. Further details of the cymbal transducer can be found in U.S. Pat. No. 6,438,242 which is incorporated by reference herein.

In the prior art, encapsulation and nodal mounting have been used to mount the cymbal transducers in an array. In the encapsulation technique, an array of the cymbal transducers is encased in polyurethane. This creates a very thin projector; however, the polyurethane damps the flexural motion of the caps, lowering the acoustic output. In addition, the presence of the polyurethane material makes replacement or repair of individual cymbal transducers cost prohibitive.

In the nodal mounting technique, each of the cymbal transducers is clamped around its outside rim. Material is not required around the dome portion of the caps, and damping does not occur. A first attempt at nodal mounting used copper clad circuit boards. Top and bottom circuit boards were provided having holes drilled in them to accommodate the dome portions of the caps. The edge portions of the transducers were held between the top and bottom boards. Plastic spacers were used to maintain a uniform distance between the top and bottom circuit boards. Although the flexing of the dome portion was unhindered, this mounting technique damped the radial motion of the piezoelectric disks causing undesirable vibration modes and abnormal acoustic radiation responses.

SUMMARY OF THE INVENTION

Accordingly, an object of the invention is to mount cymbal transducers in an array.

Another object is to provide a mounting structure for cymbal transducers that is relatively thin.

Still another object is to mount cymbal transducers without interfering with acoustic radiation from the cymbal transducers.

Yet another object is to mount cymbal transducers without transmitting radial vibration of the transducers.

Accordingly, the invention provides a mount for acoustic transducers which has a resilient sheet with a plurality of mounting apertures therein. Each mounting aperture has an annular groove formed about the inside surface of the sheet to accommodate one of the acoustic transducers. A pair of rigid, acoustically transparent plates are mounted on each side of the resilient sheet. Each plate has a plurality of communication apertures in it which correspond to the mounting apertures of the resilient sheet. The acoustic transducers are inserted into the mounting aperture of the resilient sheet. The acoustically transparent plates provide structural support for the mount.

BRIEF DESCRIPTION OF THE DRAWINGS

These and other features and advantages of the present invention will be better understood in view of the following description of the invention taken together with the drawings wherein.

DESCRIPTION OF THE PREFERRED EMBODIMENT

Figure 1:
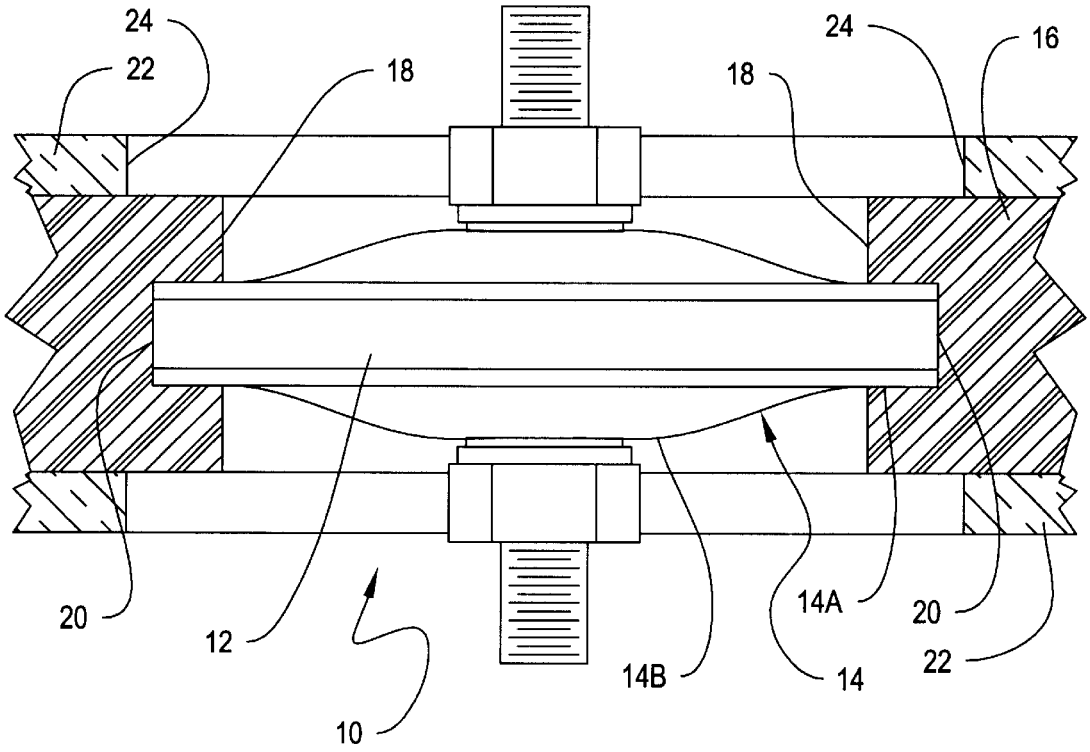
FIG. 1 is a partially cross-sectional view of the mounting of a single cymbal transducer in accordance with this invention.

This invention describes a mounting for a thin, light-weight underwater electroacoustic projector. FIG. 1 shows a cross-sectional mounting of a cymbal transducer 10. The active material in each driver 10 is a piezoelectric ceramic disk 12 poled in its thickness direction. Caps 14 are joined to the top and bottom faces of the piezoelectric ceramic disk 12. Caps 14 have an edge portion 14A and a dome portion 14B, as discussed previously.

In accordance with this invention, cymbal transducer 10 is mounted in a resilient sheet 16 having a plurality of mounting apertures 18 therein and extending therethrough. The diameter of the mounting apertures 18 is slightly larger than the diameter of the dome portion 14B of caps 14 to avoid damping of the dome portion 14B. An annular groove 20 is formed around the inner surface of the mounting aperture 18. The width of groove 20 is substantially the same as the thickness of cymbal transducer 10 at edge portion 14A and the depth of groove 20 accommodates the diameter of cymbal transducer 10.

A pair of rigid, acoustically transparent plates 22 are provided for mounting the resilient sheet 16 to a vessel or other structure. Plates 22 can be made from a thermoplastic material such as Plexiglas™ or the like. A plurality of communication apertures 24 are formed in the plates 22 that correspond with the mounting apertures 18 in the resilient sheet 16. Communication apertures 24 have diameters that are sized to avoid impeding with motion of the dome portions 14B of caps 14 and that will also insulate plates 22 from vibrations caused by cymbal transducers 10.

Figure 2:
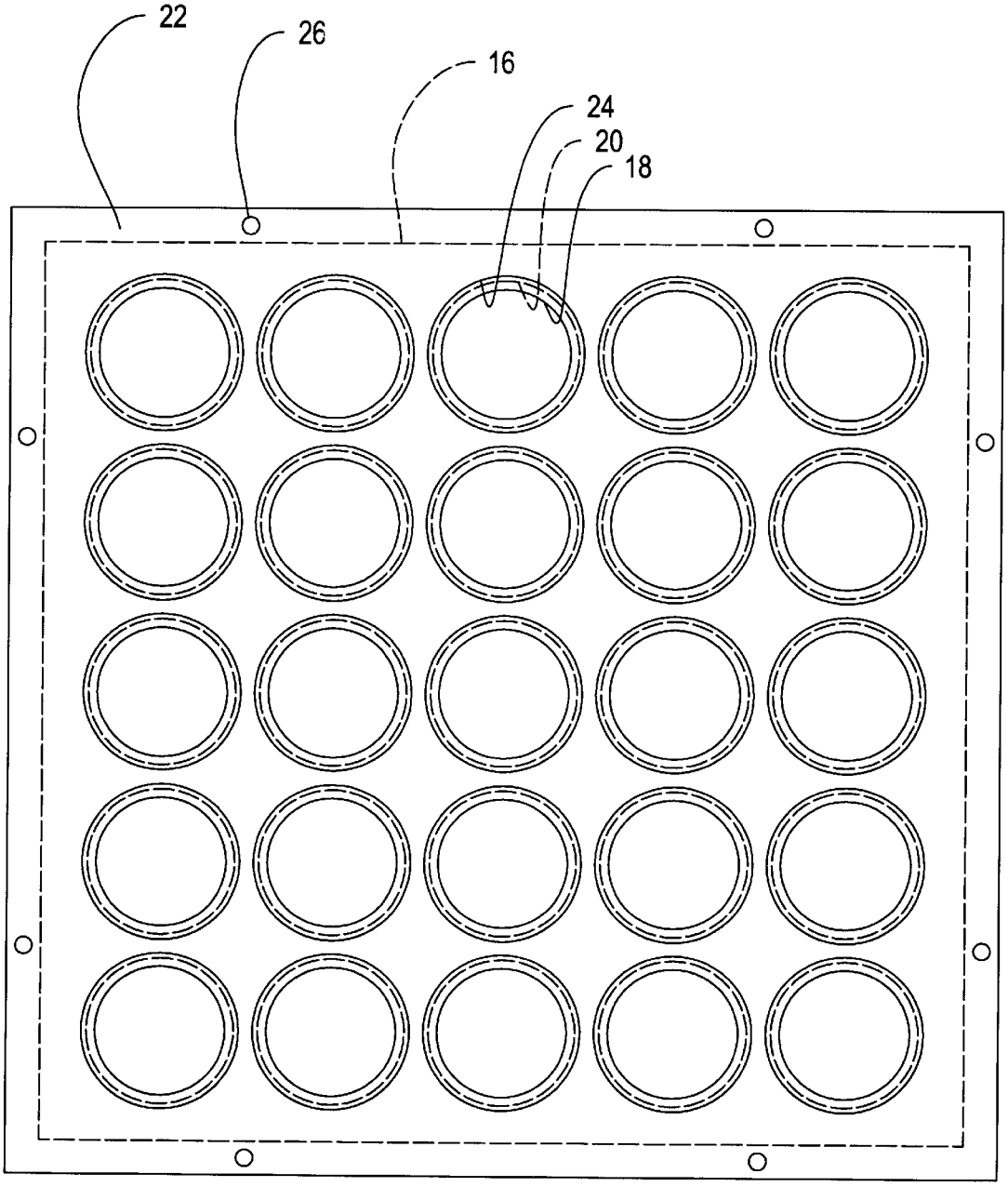
FIG. 2 is a top view of a mounting allowing multiple cymbal transducers to be mounted as an array.

FIG. 2 shows a top view of one rigid acoustically transparent plate 22 positioned on resilient sheet 16. Resilient sheet 16 is shown beneath plate 22 with hidden lines. Mounting apertures 18 are concentric with communication apertures 24. In this embodiment, communication apertures 24 are larger than mounting apertures 18 to avoid vibration transfer between resilient sheet 16 and plate 22. Annular grooves 22 are shown with hidden lines concentric with mounting apertures 18. Fastener holes 26 are formed around the outer edge of plate 22.

Resilient sheet 16 can be fabricated either by introducing liquid rubber into a mold and allowing it to cool or by laminating a plurality of vulcanized rubber sheets together that already have the appropriate sized apertures formed therein.

To mount the cymbal transducers 10, they can be inserted into mounting apertures 18 by stretching the surrounding resilient sheet 16 and positioning edge portion 14A in annular groove 20. Plates 22 can then be mounted to the top and bottom of the resilient sheet 16 by an adhesive or by slight compression with fasteners extending through fastener holes 26. Fasteners extending through fastener holes 26 can also be used to secure the completed array to another structure.

This invention allows cymbal transducers to be simply supported in the same plane without damping the transducers. The resilient sheet holds the cymbal transducers in position without interfering with either the radial motion of the disk or the flexural motion of the caps. In addition, the resilient sheet mechanically isolates the individual transducers from experiencing other external vibrations such as might be communicated from the housing or a neighboring element. The acoustically transparent plate keeps the cymbal transducers in the same plane without interfering.

The disclosure herein is only one possible alternative arrangement of the elements of this invention. For example, the resilient sheet can be bent or formed in a curved shape and retained in that shape by curved acoustically transparent plates, the apertures can be arranged in a hexagonal array rather than the rectangular array shown. The apertures can also have another shape other than round.

What is claimed is:

1. A mount for acoustic transducers comprising:

a resilient sheet having a plurality of mounting apertures formed therethrough, each mounting aperture having an annular groove formed about the inside surface thereof, said annular groove being sized to accommodate one of the acoustic transducers; and at least one pair of rigid, acoustically transparent plates, each plate having a plurality of communication apertures formed therein corresponding with said mounting apertures of said resilient sheet, one plate being mounted on a first surface of said resilient sheet and another plate being mounted on a second surface of said resilient sheet such that each said communication aperture is aligned with its said corresponding mounting aperture.

2. The apparatus of claim 1 wherein one of said at least one pair of rigid, acoustically transparent plates further has at least one fastener hole formed therein.

3. The apparatus of claim 1 wherein:

said resilient sheet is made from rubber; and said at least one pair of rigid, acoustically transparent plates are made from a thermoplastic material.

4. The apparatus of claim 3 wherein said resilient sheet is formed by introducing liquid rubber into a mold and allowing it to cool.

5. The apparatus of claim 3 wherein said resilient sheet comprises a plurality of vulcanized rubber sheets having the appropriate mounting apertures and annular grooves formed therein and laminated together.

6. The apparatus of claim 1 wherein said mounting apertures of said resilient sheet and communication apertures of said rigid, acoustically transparent plates are arranged in a rectangular pattern.

7. The apparatus of claim 1 wherein said communication apertures of said rigid, acoustically transparent plates are larger than said mounting apertures of said resilient sheet.

8. The apparatus of claim 7 wherein communication apertures of said rigid, acoustically transparent plates have a larger diameter than said annular groove of said resilient sheet.

9. The apparatus of claim 1 wherein said communication apertures of said rigid, acoustically transparent plates are circular.

10. A mount for at least one cymbal transducer having a central disk, and two end caps wherein each endcap has a dome portion and an edge portion, said mount comprising:

a resilient sheet having a plurality of mounting apertures for the cymbal transducers formed therethrough sized to accommodate the dome portion of one cymbal transducer, each mounting aperture having an annular groove formed about the inside surface thereof, said annular groove being sized to accommodate the diameter and thickness of the edge portion of one of the cymbal transducers; and at least one pair of rigid, acoustically transparent plates, each plate having a plurality of communication apertures formed therein corresponding with said mounting apertures of said resilient sheet, one plate being mounted on a first surface of said resilient sheet and another plate being mounted on a second surface of said resilient sheet such that each said communication aperture is aligned with its said corresponding mounting aperture.

11. The apparatus of claim 10 wherein one of said at least one pair of rigid, acoustically transparent plates further has at least one fastener hole formed therein.

12. The apparatus of claim 10 wherein:

said resilient sheet is made from rubber; and said at least one pair of rigid, acoustically transparent plates are made from a thermoplastic material.

13. The apparatus of claim 12 wherein said resilient sheet is formed by introducing liquid rubber into a mold and allowing it to cool.

14. The apparatus of claim 12 wherein said resilient sheet comprises a plurality of vulcanized rubber sheets having the appropriate mounting apertures and annular grooves formed therein and laminated together.

* * * * *